US008186680B2

(12) United States Patent
Pullman

(10) Patent No.: US 8,186,680 B2
(45) Date of Patent: May 29, 2012

(54) STACKING DISCS REMOVAL GAME

(76) Inventor: Donald Henry Pullman, Lynnwood, WA (US)

( * ) Notice: Subject to any disclaimer, the term of this patent is extended or adjusted under 35 U.S.C. 154(b) by 0 days.

(21) Appl. No.: 12/983,675

(22) Filed: Jan. 3, 2011

(65) Prior Publication Data

US 2012/0007311 A1 Jan. 12, 2012

(51) Int. Cl.
*A63F 3/00* (2006.01)

(52) U.S. Cl. ..... 273/266; 273/239

(58) Field of Classification Search ..... 273/336, 273/338, 339, 266

See application file for complete search history.

(56) References Cited

U.S. PATENT DOCUMENTS 1,501,942 A * 7/1924 Carman ..... 273/339
2,100,421 A * 11/1937 Wupper ..... 273/265
2,432,824 A * 12/1947 Shetler ..... 124/26
3,506,268 A * 4/1970 Stadler ..... 273/237
4,045,028 A * 8/1977 Dyess ..... 273/338
5,050,888 A * 9/1991 Schultz et al. ..... 273/248

* cited by examiner

*Primary Examiner* — Vishu K. Mendiratta
(74) *Attorney, Agent, or Firm* — Dean A. Craine

(57) ABSTRACT

A strategy dice game that incorporates a game platform that includes four color-coded pegs inserted into holes formed on the platform with an equal same number of twenty matching color discs placed thereon. The game also includes at least one numbered die and three colored die. Each numbered die includes twelve sides with two sides assigned to dots one thru four. Each colored disc also includes twelve sides. The first colored die has six faces with one dot that matches the color of one stack of disc and six faces with one dot that matches the color of another stack of discs. A second colored die has twelve faces divided so that four faces have three different colored dots. The third colored die has twelve faces divided so that three faces have four different colored dots. During play, each player takes turns simultaneously tossing the numbered die and one colored die. The player having the option of removing discs for from their assigned stack of discs or blocking other players from removing discs. The first player to remove all of their discs is declared the winner.

1 Claim, 5 Drawing Sheets

STACKING DISCS REMOVAL GAME

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to strategy games that are played by two or more players and more particularly, to a game consisting of a stationary platform having upright pegs assigned for each player and a set of discs that are strategically removed from on the pegs during play.

2. Description of the Related Art

The recreational board games that match one player against another player with the element of strategic playing and chance have always been intriguing. Intrigue is enhanced when the game requires the players to not only advance themselves towards a particular goal, but also to block or preclude other players from advancing towards their goals.

There are currently many types of games that can be played by two players using the principle of placing objects on a board or similar structure with the dual purposes of advancements towards a goal and blocking of the moment of the other players. Checkers and chess are examples of game in which board pieces are moved over dark and light squares towards a goal which may blocks movement of an opponent's pieces. Tic-tac-Toe is another game where one player's movement towards a goal blocks the other player's movement.

The instant invention is a game to be competitively played by two or more players or between two teams of players in which each player or team attempts to remove discs from a stack of discs assigned to them and also block or preclude other players from removing discs from their assigned stacks of discs.

SUMMARY OF THE INVENTION

The object of the game to be the first player to remove all of their discs from a stack of discs assigned to the player. To start the game, two to four players are selected and assigned to one particular color peg and a stack of matching colored discs placed on the peg. The pegs are then inserted into one of four peg holes formed on the corners of a stationary game platform. In the team version of the game, players are assigned to color pegs and stacks of discs on opposite sides of the game platform. The game also includes a black peg with black discs and white discs is then placed into a center peg hole formed on the game platform.

Once the player's have been assigned a peg and a stack of matching colored discs, the players then sequentially throw a numbered die to determine the first player. The player who throws the highest score using the numbered die starts the game. The numbered die includes twelve sides evenly divided into six pairs of sides each having one to six dots formed thereon.

The object of the game is to be the first player or team to remove all of the discs from their assigned colored peg. In order for a player to remove discs from his or her colored peg, the stack of discs on the peg must be 'opened'. To 'open' the stack of discs, the player must first roll his or her assigned color on the colored die. In the preferred embodiment, the assigned color on the color die matches the color of the player's stack of discs. If the stack of discs is 'opened', then the player may removes the number of discs from his or her stack of discs according to the number displayed on the numbered die.

The game is designed to be played by two players, three players, four players, or two teams with two players on each team. Accompanying the game are three colored die and one numbered die. The first colored die includes twelve faces with two different colored dots equally divided and spaced apart on the die. The second colored die includes twelve faces three different colored dots equally divided and spaced apart on the die. A third colored die includes twelve faces with four different colored dots equally divided and spaced apart on the die.

At the start of the game, the number of players is determined. The color die designed for the number of players (2, 3, or 4) is then selected. The players are assigned to a stack of discs and pegs that matches the colors on one of the colored die. Once the number of players have been determined, the stack of discs have been determined, and the first player has been determined, the first player is then handed one color die and the numbered die. Each player takes turns throwing his or her assigned color die and the numbered die in a clockwise rotation around the game platform.

During play, each player has the option of either removing one of the discs from their stack or blocking any 'opened' player. If another player's color is rolled on the colored die, the player throwing the colored die cannot remove discs from his or her stack but may still block an eligible 'opened' player. If the throwing player's stack of discs is 'blocked', then the blocked throwing player must roll their color on the colored die before they can removed colored discs from their colored stack. If the blocked player did not roll his or her color and the other player's stack is already 'blocked', then the player is unable to move and the colored numbered dice are handed to the next player.

The game is continued until one player removes all of his or her discs from his or her colored peg. In the team version of the game, the players are able to help other remove their teammate's discs or unblock there teammates.

DESCRIPTION OF THE PREFERRED EMBODIMENT(S)

Figure 1:
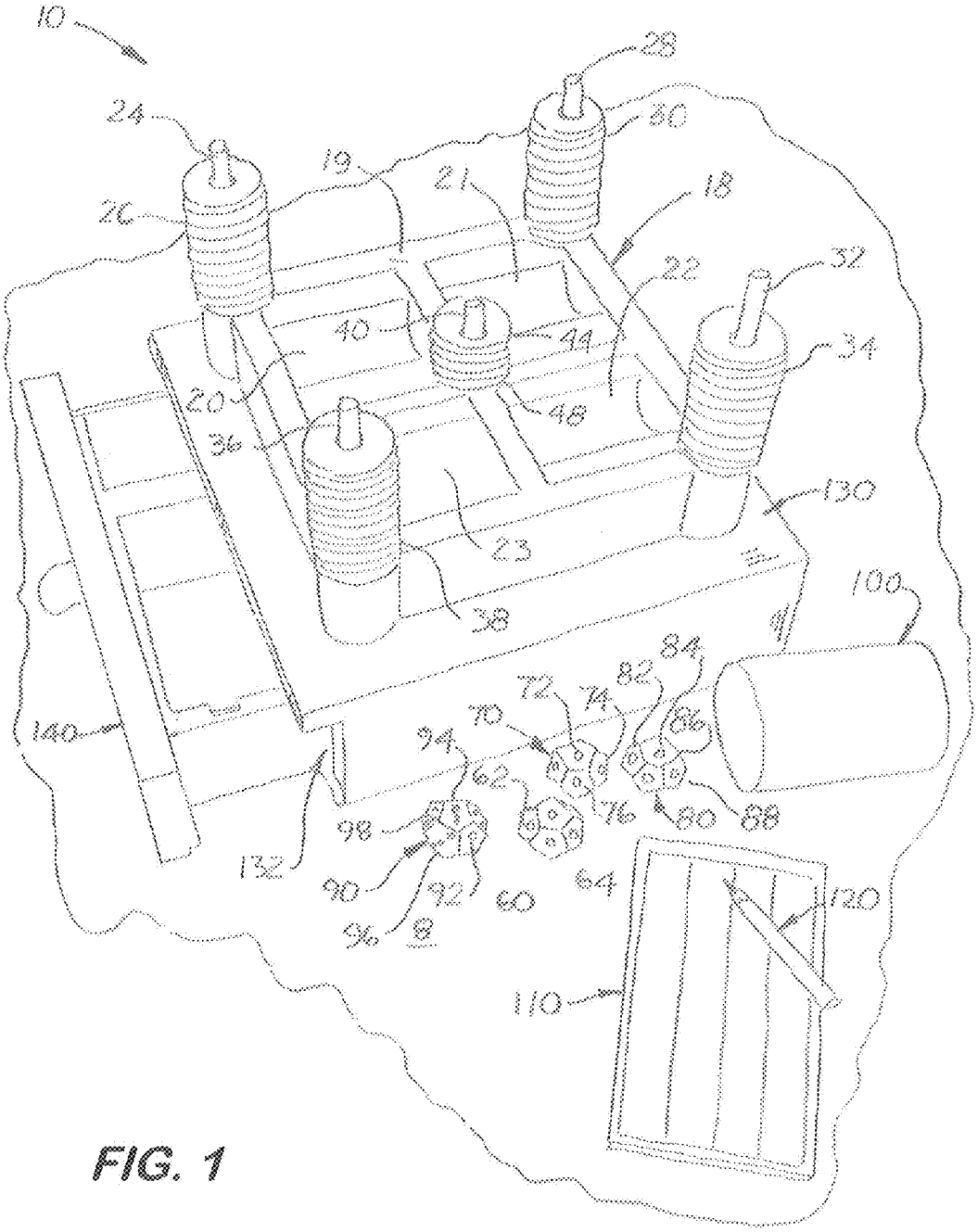
FIG. 1 is a perspective view of the stacking disc removal game disclosed herein.
Figure 2:
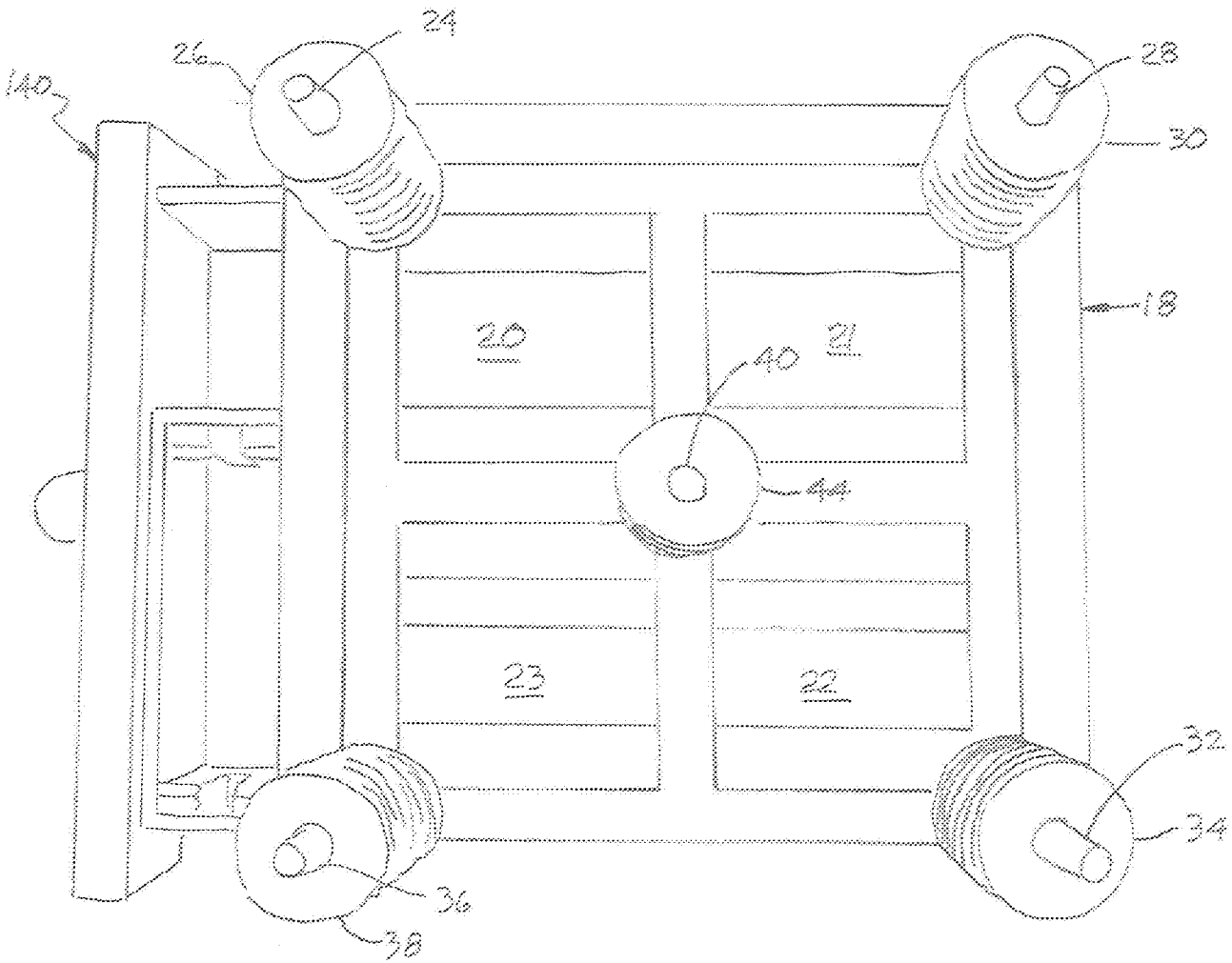
FIG. 2 is a top plan view of the platform with four stacks of discs located on all four corners.
Figure 3:
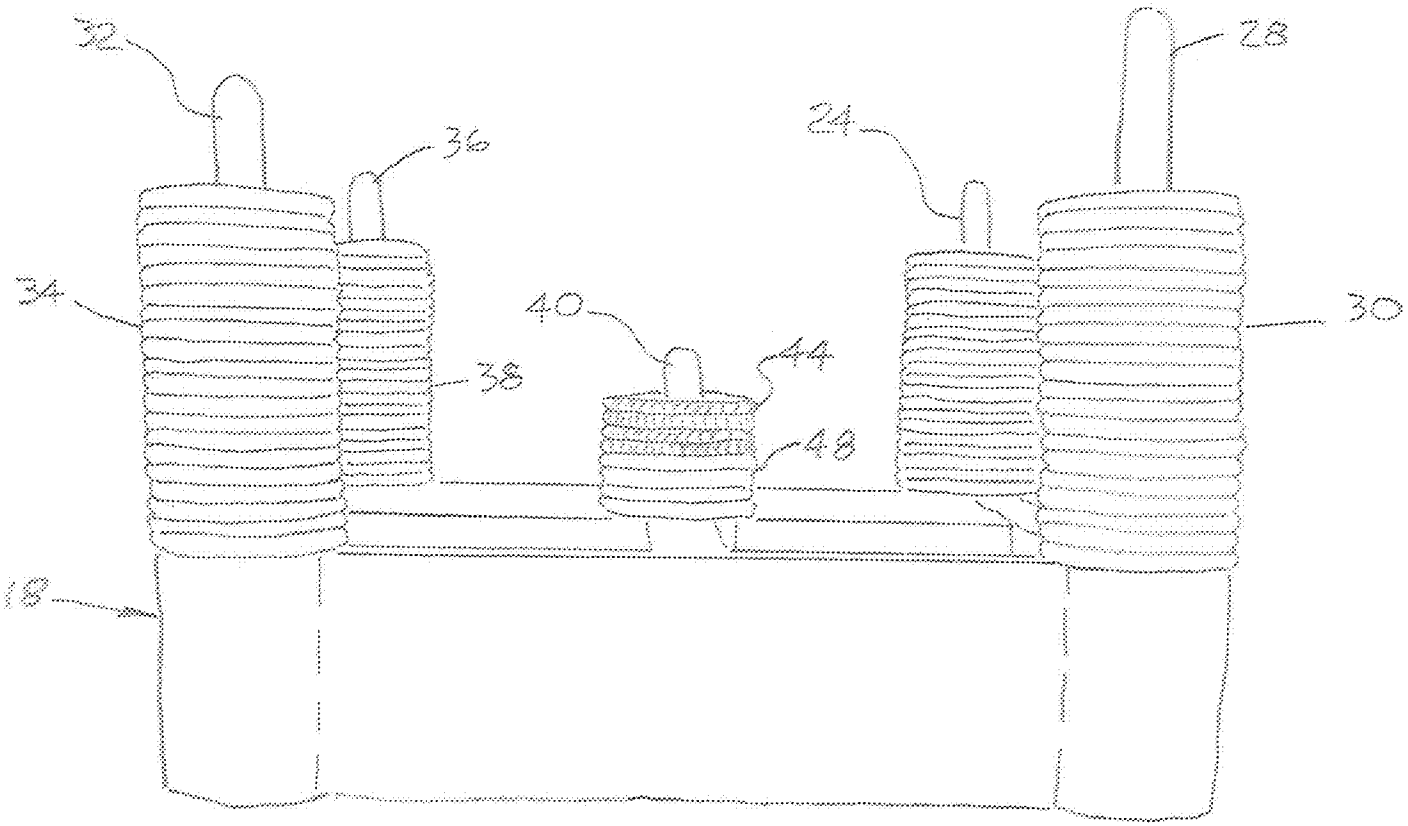
FIG. 3 is a side elevational view of the game.
Figure 4:
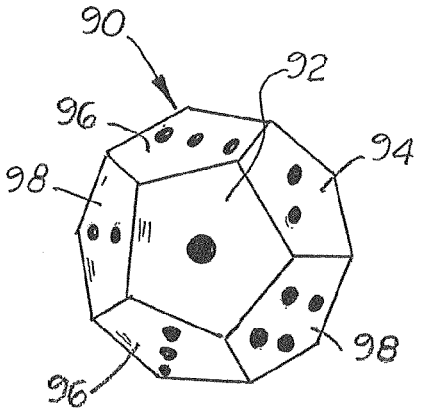
FIG. 4 is an illustration showing the front surface of the numbered dice used with the game.
Figure 5:
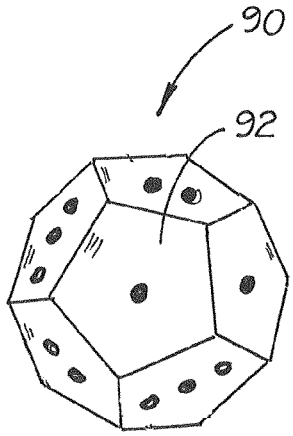
FIG. 5 is an illustration showing the front surface of the two-colored dice used with the game.
Figure 6:
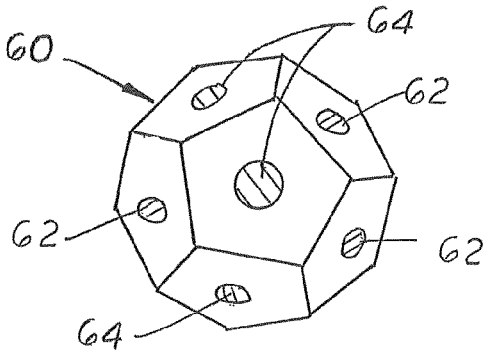
FIG. 6 is an illustration showing the front surface of the three-colored dice used with the game.
Figure 7:
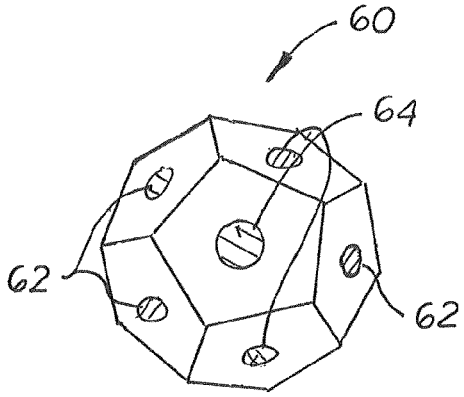
FIG. 7 is an illustration showing the front surface of the four-colored dice used with the game.
Figure 8:
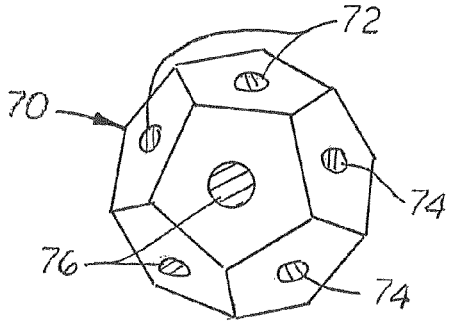
FIG. 8 is an illustration showing the back surface of the numbered dice used with the game.
Figure 9:
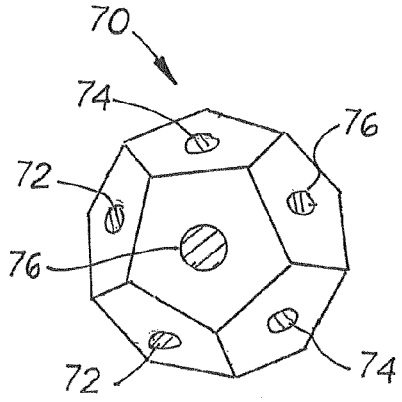
FIG. 9 is an illustration showing the back surface of the two-colored dice used with the game.
Figure 10:
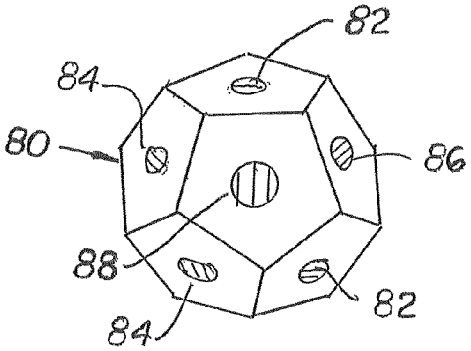
FIG. 10 is an illustration showing the back surface of the three-colored dice used with the game.
Figure 11:
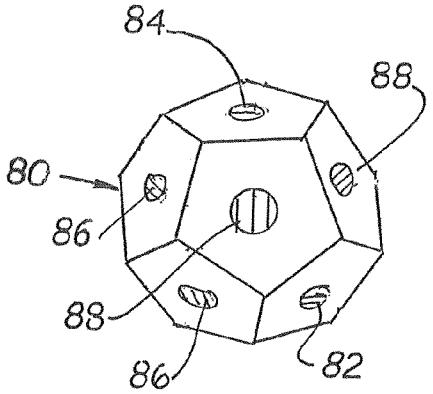
FIG. 11 is an illustration showing the back surface of the four-colored dice used with the game.

Shown in the accompanying FIGS. 1-11, there is shown a game 10 for 2-4 players, ages 6 and up. The object of the game 10 is to obtain a designated number of points. A point be awarded each time a player wins a round or the player may be awarded the number of point according to the number of discs removed from his or her peg in a round. A round is won by the first player to remove all of his or her discs from his or her assigned colored peg. A game may consist of one or more rounds.

In its most basic form, the game 10 includes a stationary game platform 18 with four uniquely corner peg 24, 28, 32, 36 and a center peg 40. Placed over the corner pegs 24, 28, 32, 36 are four stacks of discs 26, 30, 34, and 38 respectively. In the preferred embodiment, there are twenty discs in each stack 26, 30, 34, 38. Placed over the center peg 40 are three to four blocking discs 44 and four separator discs 48. In the preferred embodiment, the discs in the stacks of discs 26, 30, 34, and 38 are blue, red, yellow and green, respectively. The four blocking discs 44 are black and the four separator discs 48 are white.

The game 10 also includes one, two-colored, twelve-sided, colored die 60 each with one of two unique colored dots 62, 64 evenly dispersed and printed on its twelve faces; one, three-colored twelve-sided die 70 with one of three possible colored dots 72, 74, 76 evenly dispersed on its twelve faces; one, four colored, twelve-sided die 80 with one of four possible colored dots 82, 84, 86, 88 evenly dispersed on its twelve faces; one, twelve-sided numbered die 90 with one to four dots 92, 94, 96, and 98 printed on three surfaces of the number die 90; The game 10 may also include an optional dice throwing cup 100, an optional score card 110 and an optional pencil 120.

Prior to setting up the game 10, all of the colored pegs 24, 28, 32, 36 with discs 26, 30, 34, and 38, respectively, are inserted into the peg holes (not shown) located on the four corners of the game platform 18. The center peg 40 with black blocker discs 44 and separator discs 48 are inserted into a center hole (not shown).

In the preferred embodiment, the game platform 18 includes four recessed holding cavities 20, 21, 22, and 23 form on its top surface 19 designed to receive the four discs 26, 30, 34, and 38, respectively, as they are removed by the players during the course of the game.

In the preferred embodiment of the game, the colored die 60 has six faces with blue dots and six faces of red dots (indicated by reference numbers 62 and 64, respectively). With three players, the second colored die 70 is used with four yellow dots, four faces with blue dots, and four faces with red dots (indicated by reference numbers 72, 74 and 76, respectively). With four players, the third colored die 80 is used with three faces of blue dots, three faces red dots, three faces with yellow dots and three faces with green dots, indicated by reference numbers 82, 84, 86, and 88, respectively).

At the start of a game 10, the number of players is determined. One of the colored die 70, 80 or 90 is then selected depending on the total number of players playing (colored die 60 is used with two players, colored die 70 is used with three players, and colored die 80 is used with four players). The players are assigned to a stack of discs 26, 30, 34, 38 that matches the colors on the colored die 60, 70, or 80. Once the number of players has been determined and the stack of discs 26, 30, 34, and 38 have been assigned, the first player is then determined by the player that throws the highest number of dots on the numbered die 90. Once the first player is determined, then the first player is then handed one colored die 60, 70, or 80 and the numbered die 90. Each player takes turns throwing the designated color die 60, 70, or 80 and one numbered die 90 in a clockwise rotation around the game platform 18

Basic Version (Short Play):

To begin play, each player takes a turn rolling their colored die and the numbered die. Each player must first roll his or her color on the colored die 60, 70, or 80 into order to begin play. If the player rolls his or her color on the color die 60, 70, or 80, the number of discs may be removed from the player's stack of discs 26, 30, 34, or 38 according to the number rolled on the numbered die 90. After the player has finished his or her turn, the player left of the player who just finished, then rolls the colored die 60, 70, or 80 and the number die 90.

During play, the players may block the other players from removing discs from their pegs. In order to block a player, both players must be open (at least one disc in recessed holding cavity and not blocked). If the player rolls his or her COLOR on the colored die 60, 70, or 80, the player may choose to block any eligible 'open' player by placing a black blocker disc on top of the other player's pegged disc(s). Alternatively, the player may instead remove the number of disc(s) off his or her stack of discs according to the number presented on the number die 90 and place them in their recessed holding cavity. If the player rolls an opponent's COLOR on the colored die 60, 70, or 80, he or she can only block that color if they are eligible, or remove the number of disc(s) from his or her peg, per number dice and place them in his or her holding tray. The player's turn is then completed.

When playing with two players, the players must roll their opponent's color in order to block him or her or remove your disc(s) as per number die 90. The player cannot block an opponent if the player rolls his or her color—(i.e. they can only remove discs from their own peg).

A player can only remove a blocking disc 44 from their stack of discs during their turn. In order to do so, either the player must roll his or her COLOR on the colored die 60, 70, or 80 or roll a ONE on the numbered die 90. If the player does so, then the blocking disc 44 is then removed and returned to the center peg 40. The player is not permitted to remove colored discs from his or her stack of discs.

In order to win, the player must roll the exact number that matches the number of discs remaining on his or her peg (i.e. you need to roll a four if you have four discs left to go out, or a three if you have three discs left to go out, etc). If the player cannot roll the exact number, the player may block any eligible player.

First person to remove all 20 discs from his or her colored peg wins the game.

Scoring Version (Long Play):

In this version of the game, the only difference between Basic Version is that the players may win multiple rounds and then keep score after each round. An optional score pad 110 may be included.

At the start of the game, the players first determine the total number of points or rounds that must be won to be declared the winner. The number of points or rounds won are recorded on the score card 110. To do this, the player must decide what points to play in multiples of 20 points, noting that the higher the number the more rounds you will play. For example, 40 points=2 rounds, 60 points=3 rounds. Each round is over when a player moves all 20 of his or her discs into their recessed holding cavity, then all players count the discs that are in their recessed holding cavity and add that number to their total score.

Each round begins by placing all 20 discs onto their respective colored pegs. The player that has the lowest total score starts the round. If tied for low score after a round, go back one round and start with low score. If any player(s) is within 20 points or less of winning at the beginning of the next round, the player(s) must place a white separator disc 48 on their colored peg below the number of disc the player(s) needs to win. For example, if the players choose to play to 100 and at the end of a round a player has 93 points, the player must place a white separator disc below the top 7 discs on their colored peg before starting the next round. Like the basic version of the game, the players must roll the exact number of disc in order to win.

Child Version:

With children, the game may be modified so that only the number die 90 is used. In this version of the game, each player rolls the numbered die 90 and removes the number of disc(s) from his or her colored peg. The player's turn is then completed and the numbered die 90 is then handed to another player. The process is completed until the first player is able to remove all 20 of their discs from their colored peg. The first player to do so is declared the winner. With the children's version, the players do not have to roll in the last turn the exact number of discs in order to win.

Team Player:

In the team version of the game 10, four players are divided into two teams. The players are assigned colored pegs and stacks of discs located on opposite sides of the game platform 18 so that players of the team play in an alternating manner. The game 10 is played in the same manner as the basic and long versions except that players on the same team may assist each other in removing discs from each other's stack and unblocking the other teammate.

In the preferred embodiment, the above parts are all stored in storage box. 130. The storage box 130 may include a drawer 140 that slides into a drawing opening 132 formed on the storage box 130. As shown in the Figs., the storage box 130 may be placed under the game platform 18 to elevate the game platform 18 on the table 8. The drawer 140 is divided into three cavities (only two cavities showing 142, 144) designed to hold the four pegs 24, 28, 32, 36 with stacks of discs 26, 30, 34, 38 mounted thereon. The center peg and blocking discs and end of game discs may also be stored in a cavity along with the throw cup 110 filled with the four dice 70, 80, 90, 100, the score card 110 and pencil 120. In the preferred embodiment, the storage box 130 measures approximately 10¼ (W)×10¼ (L)×5¾ (H).

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A strategy game comprising:

a. a platform having at least two peg holes at each corner and a center peg;

b. a set of at least two corner pegs designed to be inserted into said peg holes formed on said platform, each said peg having a stack of equal number discs placed thereon;

c a plurality of blocking discs placed on said center peg;

d. at least one numbered die with twelve sides with 1 to 4 dots located on each side;

e. a first colored die with twelve faces with six faces having one colored dot that matches one of said stack of colored discs and six colored faces having one colored dot that matches the color of another stack of colored discs;

f. a second colored die with twelve faces with four faces having one colored dot that matches the color of one of said stack of colored discs, four colored faces having a colored dot that matches the color another stack of colored discs, and four colored faces having a colored dot that matches the color of another stack of colored discs; and, g. a third colored die with twelve faces with three faces having one colored dot that matches one of said stack of colored discs, three colored faces of a colored dot that matches the color of another stack of colored discs, three colored faces having a colored dot that matches the color of another stack of colored discs and three colored faces having a colored dot that matches the color of another stack of colored discs.

* * * * *